US010890420B1

(12) United States Patent
Feller

(10) Patent No.: US 10,890,420 B1
(45) Date of Patent: Jan. 12, 2021

(54) BULLET FOR AN ELECTRICALLY IGNITED FIREARM

(71) Applicant: Murray F Feller, Micanopy, FL (US)

(72) Inventor: Murray F Feller, Micanopy, FL (US)

( * ) Notice: Subject to any disclaimer, the term of this patent is extended or adjusted under 35 U.S.C. 154(b) by 0 days.

(21) Appl. No.: 16/693,244

(22) Filed: Nov. 23, 2019

Related U.S. Application Data

(63) Continuation-in-part of application No. 16/517,780, filed on Jul. 22, 2019.

(51) Int. Cl.

| | |
|---|---|
| ***F42B 5/08*** | (2006.01) |
| ***F42B 14/06*** | (2006.01) |
| ***F42B 5/28*** | (2006.01) |
| ***F42B 5/38*** | (2006.01) |

(52) U.S. Cl.
CPC ..... *F42B 5/08* (2013.01); *F42B 5/28* (2013.01); *F42B 5/38* (2013.01); *F42B 14/06* (2013.01)

(58) Field of Classification Search
CPC .. F41A 19/58; F41A 19/69; F42B 5/08; F42B 5/28; F42B 5/38; F41C 9/08
USPC ..... 42/51, 84; 89/28.05
See application file for complete search history.

(56) References Cited

U.S. PATENT DOCUMENTS

| | | | | |
|---|---|---|---|---|
| 26,016 | A | 11/1859 | Cochran | |
| 1,468,822 | A * | 9/1923 | Ludorf | F42B 5/08 102/380 |
| 3,815,503 | A * | 6/1974 | Infantino | F42B 15/00 102/374 |
| 4,332,098 | A * | 6/1982 | Estenevy | F41A 3/94 102/472 |
| 5,625,972 | A * | 5/1997 | King | F41A 19/58 102/472 |
| 6,374,525 | B1 * | 4/2002 | Thomas | F41A 19/58 42/51 |
| 9,429,406 | B2 * | 8/2016 | Harrison | F42B 14/00 |
| 2003/0056416 | A1 | 3/2003 | Crowson | |
| 2005/0188872 | A1 * | 9/2005 | Oertwig | F42C 19/08 102/202 |
| 2007/0144393 | A1 | 6/2007 | Kusz | |
| 2008/0434928 | | 6/2008 | Shiery | |

* cited by examiner

*Primary Examiner* — Bret Hayes
(74) *Attorney, Agent, or Firm* — David Kiewit

(57) ABSTRACT

A separate-loading firearm uses a battery-powered electric resistance heating element to ignite a propellant charge. Both ignition reliability and ballistic reproducibility are enhanced when a first portion of the propellant charge is consistently and firmly packed into a cavity formed in a rear surface of a bullet. This first portion may be sealed in the cavity by a membrane. A second portion of the propellant charge is packed within a firing chamber so that it abuts both the heating element and the first portion of the propellant charge.

2 Claims, 4 Drawing Sheets

BULLET FOR AN ELECTRICALLY IGNITED FIREARM

REFERENCE TO OTHER APPLICATIONS

This application is a continuation in part of Applicant's U.S. patent application Ser. No. 16/517,780 filed on Jul. 22, 2019, the disclosure of which is herein incorporated by reference.

BACKGROUND OF THE INVENTION

Both ignition reliability and ballistic reproducibility improve when a propellant charge is consistently and firmly packed within a firing chamber of a muzzle-loading firearm. Moreover, once a desired packing is achieved, it must be retained for long periods of time during which the firearm is stored, handled, or carried about.

BRIEF SUMMARY OF THE INVENTION

One aspect of the invention is that it provides a separate-loading firearm in which a selected amount of a propellant is captured between an electric resistance heating element adjacent a firing chamber wall and a projectile having an interference fit within a barrel of the firearm. The firearm also comprises switching circuitry operable to selectively connect the heating element to an electric current source for a firing pulse interval having a magnitude and duration adequate to heat the heating element to a temperature high enough to ignite an abutting portion of the propellant. In some embodiments the projectile comprises a front-weighted metal body having a cavity in a rear end and a circumferential groove adjacent a front end. The groove has a front groove wall shorter than a rear groove wall so that when an O-ring having an outer diameter slightly greater than an inner diameter of the barrel and a width substantially equal to twice the difference in groove wall heights is disposed in the groove, the projectile can be rammed into a loaded configuration in which the propellant abuts the heating element.

Another aspect of the invention is that it provides a method of loading a separately loaded firearm comprising an electric heating element disposed in a firing chamber at a breech thereof. This method comprises a sequence of steps, an early one of which comprises pouring a first selected quantity of a propellant powder into a muzzle of the firearm. As will be subsequently described herein, the selected quantity may constitute the entire desired powder charge, or may be a relatively small portion of powder that is captured between an electric resistance heating element and a rear end of a main propellant charge disposed within a cavity in the rear end of a bullet inserted into a muzzle and rammed into the firing chamber. In this arrangement a preferred projectile has a circumferential groove adjacent the front end. This groove may have a front wall with a smaller radial extent than its back wall. The projectile may further have an O-ring disposed in the groove. The projectile is rammed into the barrel by using a partially hollow tubular or cupped rammer having an outer diameter slightly less than an internal diameter of the firearm and an internal void having a size and shape selected to ensure that when the rammer contacts the O-ring it does not contact other portions of the projectile.

Yet another aspect of the invention is that it provides a projectile for a separately loaded firearm. The preferred projectile comprises a metal body having a circumferential groove adjacent its front end. This groove has a front groove wall that is shorter than a rear groove wall. An O-ring disposed in the groove has an outer diameter slightly greater than an inner diameter of the barrel of the firearm so as to provide an interference fit of the projectile in that barrel. In some embodiments the projectile further comprises a cavity opening to its rear, breech-facing, end for holding a selected quantity of propellant.

Those skilled in the art will recognize that the foregoing broad summary description is not intended to list all of the features and advantages of the invention. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases. Of particular concern for this document are the terms 'muzzle-loading' and 'separate-loading' which are sometimes interchangeable. Both stand for arms that do not use fixed ammunition and in which a projectile is inserted into a firing chamber that has previously been charged with a propellant and is thus separately loaded. A large fraction of separately-loaded small-arms are loaded through the muzzle but some, notably revolvers, provide loading access at a front of a chamber or chambers.

Figure 1:
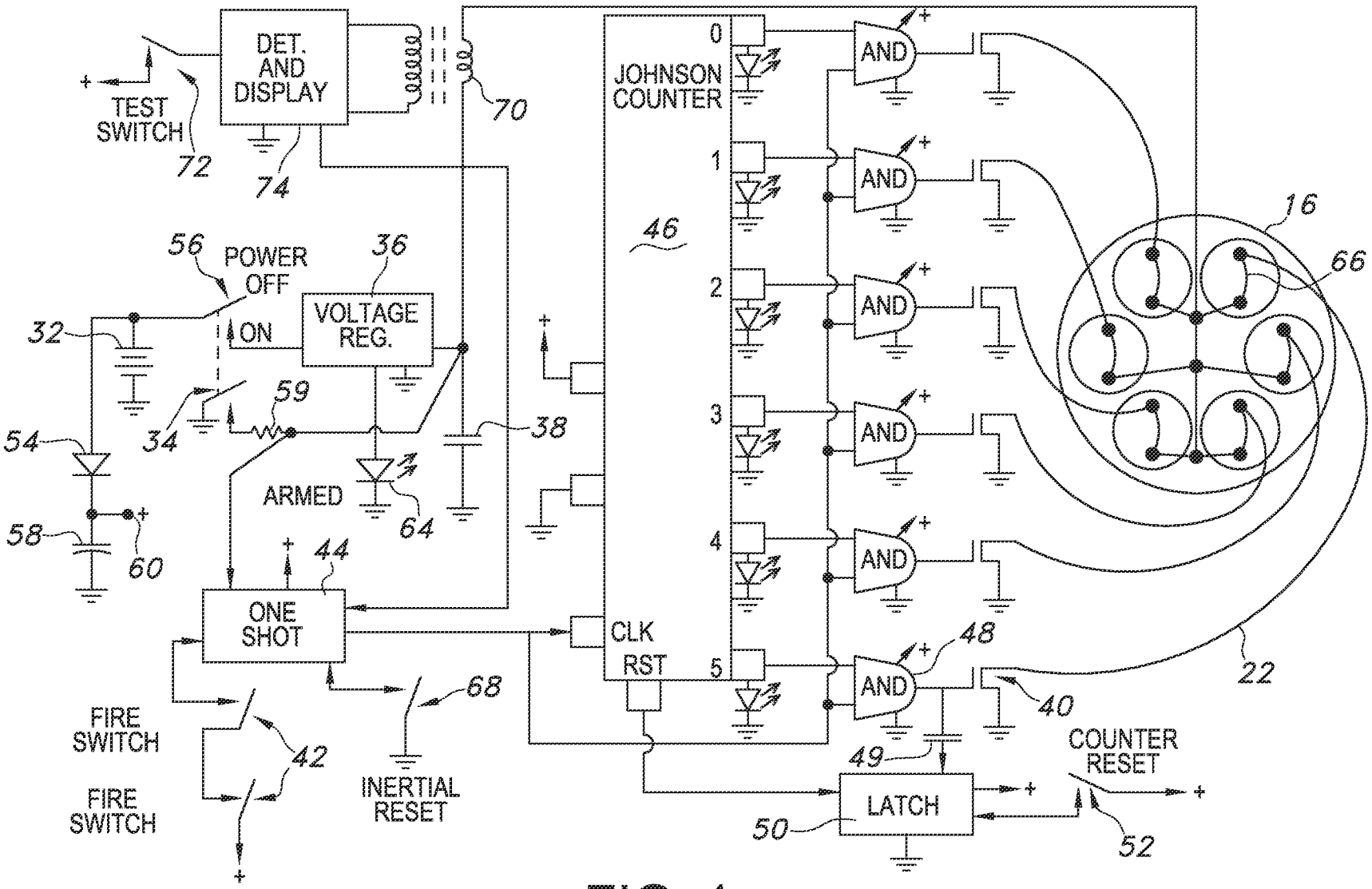
FIG. 1 is a simplified block diagram of an electronic circuit for operating and testing a separate-loading firearm.
Figure 3:
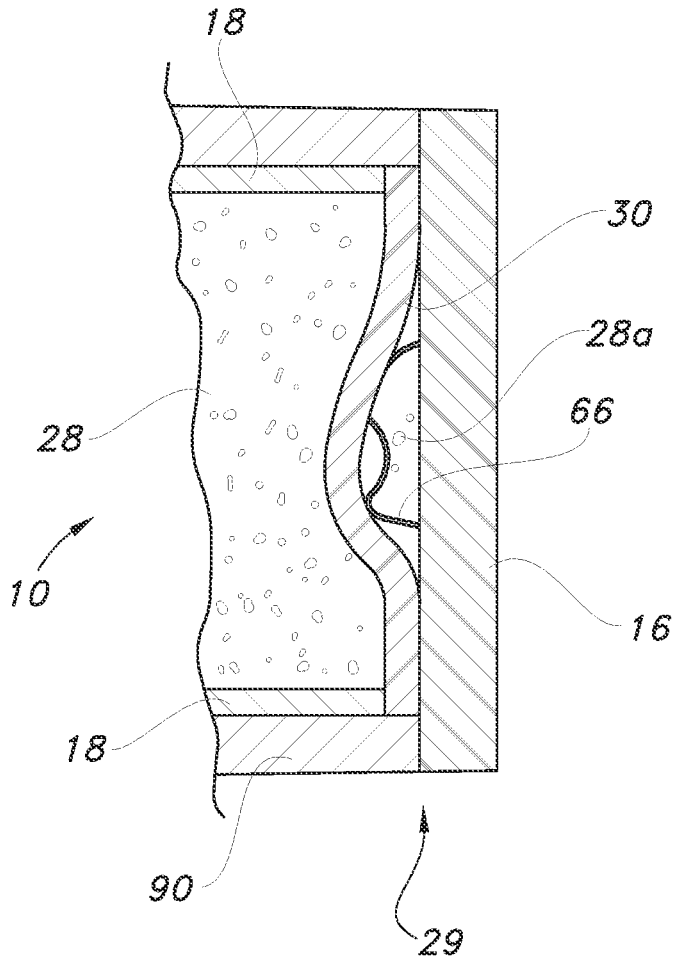
FIG. 3 is a partly schematic sectional detail view of a heating element engaging a projectile of FIG. 2.

FIG. 1 is a simplified block diagram of an electronic igniter circuit. In this example, a circuit board 16 is located at the end of a firing chamber 29 portion of a barrel 90. The exemplar circuit board 16 supports six heater wires 66 each of which is respectively associated with a respective barrel 90 as schematically depicted in FIG. 3. Electrical power from a battery 32 is connected through an ON/OFF power switch 56 to a voltage regulator 36 which charges a super capacitor 38 to a designated voltage, for example five volts, and selectively switches current through a respective transistor 40 to the heater wire(s) 66 of a respective associated firing chamber 29. A user-operated firing switch (or switches) 42, when momentarily switched "ON" triggers a one-shot 44 to produce a pulse, typically having a duration of 200 milliseconds, which clocks a counter 46, advancing it one step through its outputs (of which six are depicted) each time the firing switch 42 is closed. Those outputs are supplied to respective AND circuits 48 along with the pulse from the one shot. The reader will recognize that a single switch 42 is adequate to initiate the firing cycle. In the depicted preferred embodiment, two series-connected switches are employed in the interest of safety as will be described subsequently herein.

The AND circuit output pulse durations are the same as that of the one shot 44. When the last chamber has been fired, a capacitor 49 transfers the trailing edge signal of the firing pulse to a latch 50 which resets the counter 46 to a zero-output state that is maintained until the latch is manually reset by a reset switch 52. Until the latch is reset, the heater wires 66 cannot be energized. The reset is usually activated after the chambers have been reloaded or during testing. The number of output steps may be made selectable to accommodate different numbers of chambers that are employed when the circuit is used with different firearm configurations.

The battery 32 continuously powers the control portions of the circuit through a diode 54 thereby enabling those circuit elements to retain their electrical state when the power switch 56 is placed in the "OFF" position. Alternatively, a microprocessor may be used to perform all of the logic functions required and incorporate a non-volatile memory retaining all of the logic states when the power is switched "OFF". A capacitor 58 stores charge which is isolated from the battery so that when a voltage transient occurs at the battery, as may happen when firing takes place, the voltage available to the control portions of the circuit as designated by a terminal 60, is constant.

After the power switch is placed in the "OFF" position, the super capacitor 38 is grounded by a switch 34 through a resistor 59, thereby discharging it in a short period of time for safety. In the ON state a LED 64 is preferably connected to a signal source in the voltage regulating circuit and is readily viewable by the user when the super capacitor is fully charged (other notifying devices such as a vibrator can also be used) and that the firearm is ready to be fired. The various logic steps for this operation may be carried out in preferred embodiments by a CMOS monostable multivibrator of the sort conventionally designated as 74VHC123A or 74VHC221A.

A super capacitor has been used in the foregoing example as a supply of high current pulses to the heater wires because of peak current limitations characteristic of small long-life batteries.

Preferred heater wires 66 are made from alloys used for resistance heating (e.g., Kanthal A1) and need to be of very small mass so that they will come up to the required ignition temperature quickly. The wires are therefore necessarily of very small diameter, for example 0.003", and although relatively fragile, yet are still practical for this application. The wires retain much of their strength at temperatures well over 1000 degrees Celsius to comfortably serve as the ignition source. Alternately, one could consider using known thin film or thick film approaches to form low-mass heater arrays on a suitable refractory substrate.

Good ignition has been observed when a wire heater is used with a double base smokeless powder sold by Western Powders Inc. under the trade name of Accurate #9, which has an ignition temperature of about 293 degrees Celsius. The reader will note that the invention is not limited to a particular propellant and that a wide range of powder compositions and grain sizes, as well as pelletized propellants can be considered. For example, other propellants used in conventional cartridges have been used successfully.

The heater wires 66 preferably abut a supporting surface such as an igniter PC board 16 which may provide pads of thermally and electrically insulating material, such as mica, disposed between the wires and the PC board. This arrangement minimizes strains in the heater wires when the propellant 28 is squeezed against the wire during reloading. Moreover, wire movement is inhibited by the board when the structure is subjected to turbulent gases during firing.

Figure 2:
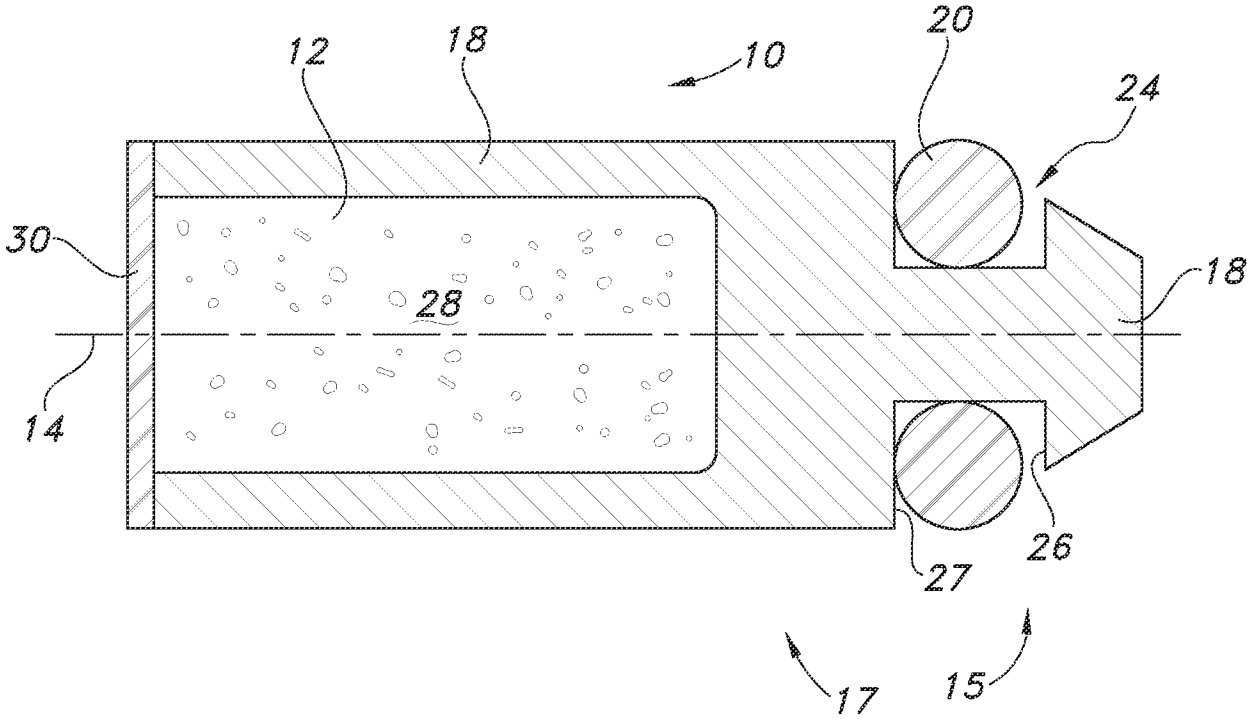
FIG. 2 is a longitudinal cross-sectional view of a preferred projectile of the invention.

Reproduceable and reliable ignition is enhanced by ensuring that the heater element 66 is in good mechanical contact with the propellant 28. In a preferred embodiment shown in FIGS. 2 and 3 a cavity 12 in the breech-facing end of a bullet 10 is completely filled with a suitable propellant 28 which is sealed into place by a thin membrane 30 that abuts the heating element when the bullet is rammed into the firing chamber. Ignition reliability and projectile muzzle energy can be further enhanced by loading additional propellant particles 28*a* before the bullet is inserted and rammed home. In this case the expectation is that some particles will be in abutting contact with the heater element 66 and the membrane 30.

The membrane 30 preferably presents an electrically insulating external surface if it directly contacts a heater 66 or terminal thereof. Tests have shown that aluminum foil can be successfully used as the membrane if additional propellant 28*a* is provided between the heater and the membrane 30.

It may be noted that forming the trailing-end cavity 12 in a nominally solid bullet reduces its weight and shifts the center of gravity toward the muzzle-facing end of the projectile. The shift in center of gravity aids in stabilizing the bullet once it has left the weapon. Adding additional material to the bullet to make up for reduction associated with the cavity can add to the length of the bullet and contribute further to exterior ballistic stability.

A preferred bullet 10 is rotationally symmetric about an axis 14 and comprises an O-ring 20 disposed in a circumferential groove 24 that may be adjacent a position along the bullet's axis where there is a transition between an ogive and a cylindrical shape. This groove 24 is similar to grooves for rotating bands used in ordnance ammunition, but has asymmetric wall heights providing a muzzle-facing front wall 26 that is lower than the breech-facing rear wall 27 by substantially one half of the width of the O-ring 20.

Figure 4:
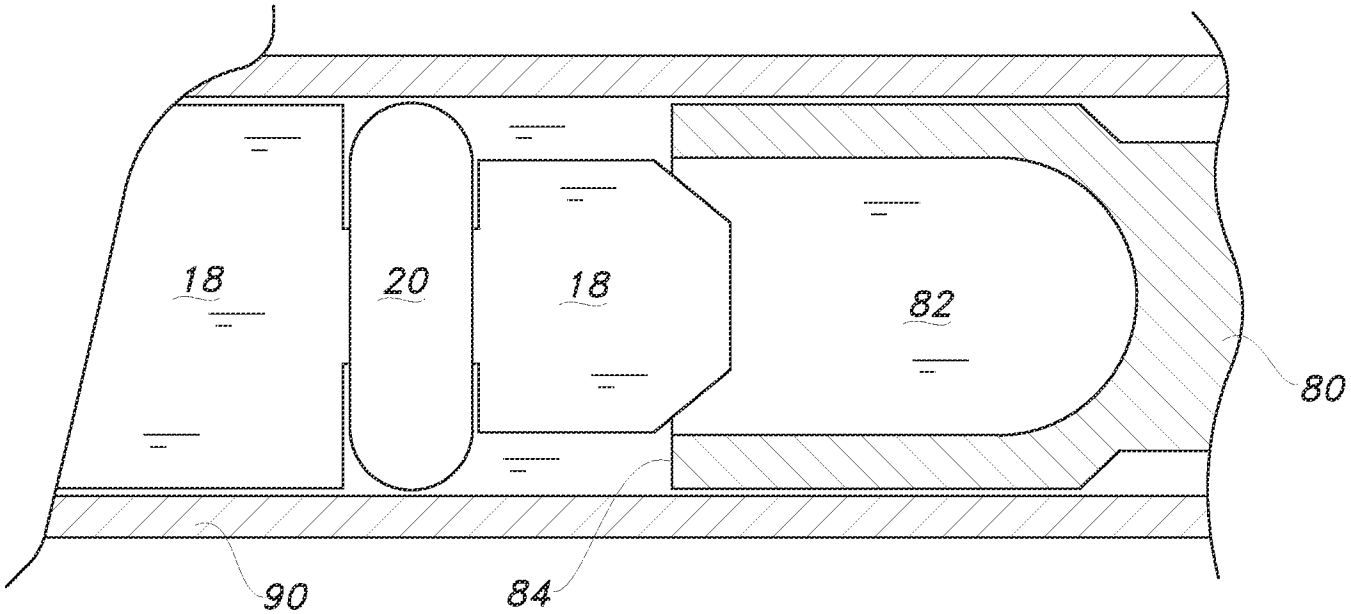
FIG. 4 is a composite detail view in which a front portion of a bullet of the invention, shown in elevation, abuts a gun barrel and a rammer, both shown in section.

In the preferred loading arrangement the O-ring 20 is chosen to have an outer diameter that provides an interference fit within the firearm's barrel 90. This O-ring is mounted in the asymmetric groove 24 in the bullet which is then driven into the firearm's barrel by using a cupped-end rammer 80 that bears directly on the portion of the O-ring exposed by the relatively short front wall 26 of the groove 24. The preferred rammer 80, as depicted in FIG. 4, has an outer diameter slightly less than an internal diameter of the firearm's barrel 90, and a working rim 84 with a width just a bit less than one half of the width of the O-ring. This arrangement allows the working rim 84 of the rammer 80 to directly bear on the O-ring 20 without directly bearing on any other surfaces of the bullet 10.

The area over which the rammer 80 contacts the O-ring 20 is preferably as large as practical in order to increase both the magnitude and homogeneity of the residual elastic forces holding the bullet 10 in place and providing a long-term environmental seal for the propellant.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

The invention claimed is:

1. A separate-loading firearm having a selected amount of a propellant captured between a firing chamber wall and a projectile having an interference fit within a barrel of the firearm, wherein:

the firearm comprises at least one electric resistance heating element adjacent the firing chamber wall and further comprises switching circuitry operable to selectively connect the heating element to an electric current source for a firing pulse interval having a magnitude and duration adequate to heat the heating element to a temperature high enough to ignite an abutting portion of the propellant;

the projectile comprises a metal body having a cavity in a rear end thereof and a circumferential groove adjacent a front end thereof, the groove having a front groove wall shorter than a rear groove wall; and an O-ring disposed in the groove, the O-ring having an outer diameter slightly greater than an inner diameter of the barrel so as to provide the interference fit; and wherein the selected amount of propellant comprises a first portion disposed in the cavity and a second portion abutting both the heating element and the first portion of propellant.

2. A method of loading a separately loaded firearm comprising an electric heating element disposed at a breech end of a barrel thereof, the method comprising the sequentially executed steps of:

a) pouring a first selected quantity of a propellant powder into a muzzle of the firearm;

b) inserting a rear, breech-facing, end of a projectile into the muzzle, the breech-facing end of the projectile comprising a cavity holding a second selected quantity of the propellant; the projectile having a circumferential groove adjacent a front, muzzle-facing end thereof, a front wall of the groove having a smaller radial extent than a back wall thereof, the projectile further comprising an O-ring disposed in the groove;

c) ramming the projectile into the barrel by using a partially hollow rammer having an outer diameter slightly less than an internal diameter of the barrel and an internal void having a size and shape selected to ensure that when the rammer contacts the O-ring it does not contact the front end of the projectile.

* * * * *